United States Patent [19]

Lockwood

[11] Patent Number: 4,797,030

[45] **Date of Patent: * Jan. 10, 1989**

[54] PRECAST CONCRETE CULVERT SYSTEM

[75] Inventor: William D. Lockwood, Dayton, Ohio

[73] Assignee: Con/Span Culvert Systems, Inc., Dayton, Ohio

[ * ] Notice: The portion of the term of this patent subsequent to Jun. 17, 2003 has been disclaimed.

[21] Appl. No.: 86,064

[22] Filed: Aug. 17, 1987

Related U.S. Application Data

[63] Continuation-in-part of Ser. No. 853,206, Apr. 17, 1986, Pat. No. 4,687,371, which is a continuation of Ser. No. 566,438, Dec. 28, 1983, Pat. No. 4,595,314.

[51] Int. Cl.[4] ..... E01F 5/00

[52] U.S. Cl. ..... 405/125; 405/33; 405/124

[58] Field of Search ..... 405/46, 53, 124, 125, 405/126, 134, 136

[56] References Cited

U.S. PATENT DOCUMENTS

| | | | |
|---|---|---|---|
| 862,292 | 8/1907 | Stoffer | 405/124 |
| 925,019 | 6/1909 | Parks et al. | 405/126 X |
| 1,028,638 | 6/1912 | Thorsby | 405/124 |
| 1,060,271 | 4/1913 | McBean et al. | 405/136 |
| 1,144,200 | 6/1915 | Hewett | 405/125 |
| 1,184,634 | 5/1916 | Duerrwachter | 405/126 X |
| 1,412,616 | 4/1922 | Kammerer et al. | 138/102 |
| 3,570,251 | 3/1971 | Roberts | 405/46 |
| 4,141,666 | 2/1979 | DeGraff | 405/126 |
| 4,211,504 | 7/1980 | Sivachenko | 405/124 X |
| 4,239,416 | 12/1980 | Borca et al. | 405/53 |
| 4,595,314 | 6/1986 | Lockwood | 405/125 |
| 4,687,371 | 8/1987 | Lockwood | 405/125 |

OTHER PUBLICATIONS

BEBO Concrete Arch Culvert, Zurn Industries, Inc., 1982.

*Primary Examiner*—David H. Corbin

*Attorney, Agent, or Firm*—Jacox & Meckstroth

[57] ABSTRACT

A precast concrete culvert system includes a series of open bottom culvert sections each having parallel spaced vertical side walls integrally connected to an arcuate top wall having a curved inner surface with a radius of curvature at least twice the rise defined between the top center of the curved inner surface and the bottom surfaces of the side walls. The side walls rest on footers and have outer surfaces which form sharp corners with the top surface of the top wall and have a vertical height at least sixty percent and preferably between eighty and ninety percent of the rise. The vertical height is also less than fifty percent of the radius of curvature which is between twenty and fifty feet and preferably either about twenty-five or forty feet. The end sections have vertical head walls, and the vertical side walls are adapted to connect with angularly disposed vertical concrete wing walls to provide for a smooth hydraulic flow into and through the series of the culvert sections. Culvert sections may also be formed to form a curved conduit or an underground tank.

8 Claims, 1 Drawing Sheet

PRECAST CONCRETE CULVERT SYSTEM

RELATED APPLICATIONS

This application is a continuation-in-part of application Ser. No. 853,206, filed Apr. 17, 1986, now U.S. Pat. No. 4,687,371, which is a continuation of application Ser. No. 566,438, filed Dec. 28, 1983, now U.S. Pat. No. 4,595,314.

BACKGROUND OF THE INVENTION

This invention relates to the production of precast concrete culvert sections which are usually installed in end-to-end alignment in the ground for directing a stream under a roadway and in place of using a bridge for spanning the stream. In the construction of such precast concrete culvert sections, it is desirable for the sections to have a configuration which effectively and efficiently utilizes the lateral forces acting on the side walls of the culvert section by the surrounding earth or soil to provide the culvert section with high strength for supporting substantial vertical loads on the top wall of the section. It is also desirable for the culvert section to have a minimum wall thickness, provide for a smooth flow of water into and through the culvert section and permit the maximum flow of water with a minimum overall height or rise of the culvert section. In addition, it is desirable for the culvert section to be constructed so that culvert sections with different spans and different heights or rises may be economically produced in order to accommodate water streams of various sizes.

Different forms of concrete culvert sections have been either proposed or made, for example, as disclosed in U.S. Pat. No. 1,412,616 and as produced by Zurn Industries, Inc. of Erie, Pa. and marketed under the trademark "BEBO". However, the culvert sections which have been previously proposed or constructed fail to provide all of the above desirable features, as apparent after studying and analyzing the culvert sections.

SUMMARY OF THE INVENTION

The present invention is directed to an improved precast concrete culvert system which provides all of the desirable features mentioned above, including an efficient structure which effectively utilizes the forces exerted by the surrounding soil to provide high strength for supporting substantial vertical loads. The culvert system of the invention may also be efficiently produced in different spans and rises with a simple and economically constructed forming system and provides for attaching vertical concrete wing walls to produce a hydraulically smooth flow through the culvert sections. The above mentioned features and advantages of the invention and other features and advantages will be apparent from the following description, the accompanying drawing and the appended claims.

DESCRIPTION OF THE PREFERRED EMBODIMENTS

Figure 1:
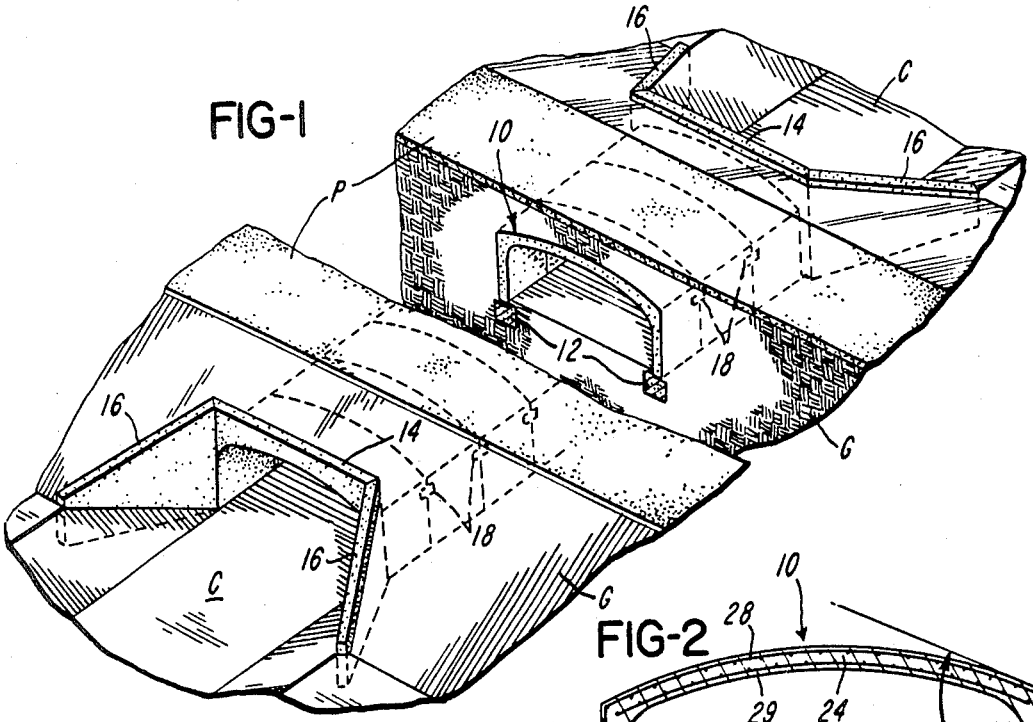
FIG. 1 is a perspective view of an underground installation of a concrete culvert system including several culvert sections constructed in accordance with the invention to provide for a flowing stream under a roadway, and with a center portion broken away.

FIG. 1 illustrates a precast concrete culvert system including a series of precast concrete culvert sections 10 which are placed in alignment or end-to-end on parallel spaced continuous concrete footers 12 formed with trenches in the ground. The footers 12 may be connected by a poured concrete slab, and the assembled culverts 10 are covered by compacted soil G after the culvert sections are placed on the footers 12. The compacted soil supports a roadbed for a roadway or pavement P which extends across the assembled culvert sections. The opposite precast end sections of the assembled culvert sections 10 connect with integral corresponding vertical head walls 14 and vertical wing walls 16 which may be precast and extend outwardly at an angle to define an entrance and exit for water flowing in the channel C formed within the soil. Preferably, adjacent culvert sections 10 are secured together by welding or bolting abutting metal plates 18 having portions embedded within the concrete.

Figure 2:
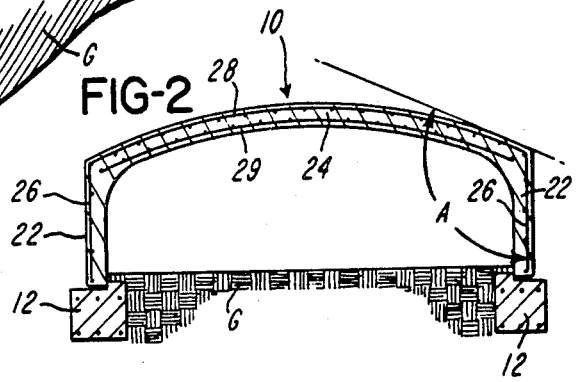
FIG. 2 is a vertical cross-section through one of the culvert sections shown in FIG. 1.
Figure 3:
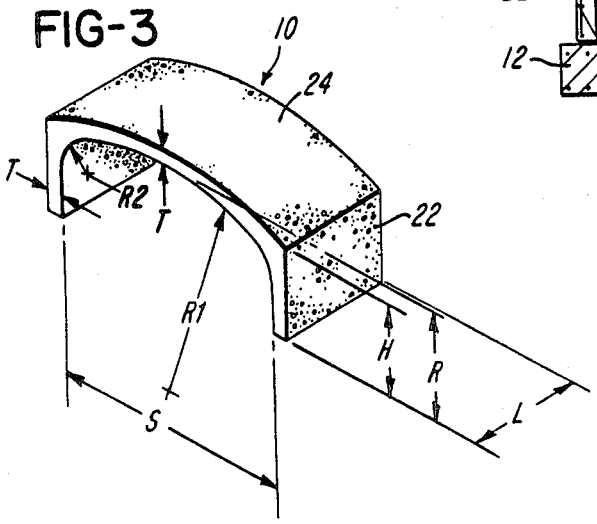
FIG. 3 is a perspective view of a culvert section shown in FIGS. 1 and 2.

Referring to FIGS. 2 and 3, each of the culvert sections 10 includes parallel spaced vertical side walls 22 which are integrally connected to an arcuate top wall 24. The inner surface of the top wall 24 has a radius of curvature R1 which is between twenty feet and fifty feet and preferably about twenty-five feet or forty feet depending on the span S defined between the parallel inner surfaces of the side walls. The thickness T of the side walls and the top wall is within a range of eight inches to fourteen inches, and a thickness T of ten inches has been found suitable for spans S between fourteen feet and thirty-six feet.

The outer surfaces of the side walls 22 have a height H which is at least sixty percent of the rise R defined between the bottom surfaces of the side walls and the top inner surface of the top wall 24. The vertical height H of the side walls 22 is also less than fifty percent of the radius of curvature R1 which is at least twice the rise R. In the optimum construction of each culvert section 10, the height H of the side walls 22 is between eighty and ninety percent of the rise R, and the outer surface of each side wall 22 joins with the top surface of the top wall 24 to form a relatively sharp corner with an angle A of between 105 degrees and 120 degrees and preferably about 112 degrees. The length L of each culvert section 10 may range between four feet and ten feet, depending upon the span S, and is preferably about eight feet for most spans. The inner surfaces of the side walls 22 and the top wall 24 are joined together by a curved surface having a radius R2 of about three feet for spans S generally between sixteen and twenty-four feet and a radius of about four feet for greater spans such as thirty and thirty-six feet. This provide the corner portions with a substantially greater thickness.

As shown in FIG. 2, a grid 26 of crossing steel reinforcing rods or members are embedded within the vertical side walls 22 relatively close to the outer surfaces of the side walls, and an arcuate grid 28 of crossing steel reinforcing rods or members is embedded within the top wall 24 relatively close to the upper surface of the top wall. A similar arcuate grid 29 of crossing reinforcing rods or members is also embedded within the top wall 24 relatively close to the inner surface of the top wall. The reinforcing rods forming the grids 26, 28 and 29 substantially increase the load carrying strength of the culvert sections 10 as may be required to handle heavy loads or traffic on the crossing pavement P. In place +f the reinforcing bars forming the grids 26, 28 and 29, crimped steel fibers or ribbons may be dispersed throughout the concrete when it is being mixed. It has been determined that such reinforcing fibers or ribbons are sufficient reinforcement for many uses of the precast culvert sections.

Figure 4:
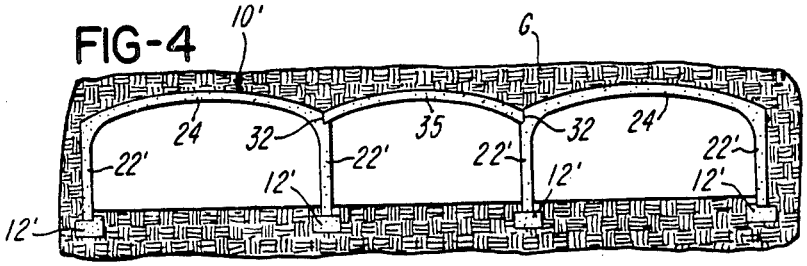
FIG. 4 is an elevational end view of a series of culvert sections assembled and connected in accordance with the invention to provide an underground water retention tank.

Referring to FIG. 4, a series of precast culvert sections 10' are arranged in parallel spaced relation on corresponding continuous concrete footers 12', and each of the culvert sections 10' is provided with a longitudinally extending recess 32 within the upper portion of one side wall 22'. The recesses 32 support precast arcuate concrete panels 35 which have a radius of curvature substantially the same as the radius of curvature R1 of the top walls 24' of the culvert sections 10'. The assembly of the culvert sections 10' and arcuate panels 35 illustrated in FIG. 4 is ideally suited for forming an underground water retention or storage tank. For example, the tank may be used to retain temporarily water collecting from the storm sewers for a large parking lot or other large area which collects a substantial volume of water in a rain storm. The bottom of the tank may be paved with concrete or asphalt.

It has been found that the construction and assembly of culvert sections as described above in accordance with the invention, provides desirable advantages, Specifically, the above described values and relationships between the radius R1, the wall height H and the rise R provide the optimum configuration for utilizing the lateral or horizontal forces acting against the side walls 22 to support the earth or ground G and other loads on the top wall 24. The vertical side walls 22 also provide for connecting the vertical wing walls 16 in a manner which produces a smooth flow of water into and from the culvert formed by the sections 10. The forces of the earth acting horizontally against the upper corners of the side walls 22 are also effective in helping to counteract the outward forces on the side walls 22 by the downward forces or loads on the arcuate top wall 24.

The concrete culvert sections 10 may also be efficiently precast on end and in metal forms which provide for conveniently changing the span S and the height H of the side walls 2. That is, the height of the side walls 22 may be varied by repositioning bulkheads within the forms for the side walls, and the span may be conveniently varied by adding or removing curved form sections for the top wall 24 and having the radius R1. Thus the radius R1 remains constant or the same for culvert sections with different spans S, and the corner portions where the side walls 22 join with the top wall 24 also remain constant with culvert sections of different spans S.

It is also within the scope of the invention to precast each culvert section with the outer surfaces of the side walls 22 and the top wall 24 with a cavity or recess which reduces the wall thickness within the center portions of the walls and thereby reduces the volume of concrete required to make each section. In this configuration, the thicker edge or end portions of the walls are provided with additional reinforcing steel. The culvert sections may also be conveniently made in a tapered configuration with one side wall 22 being narrower than the other side wall so that a series of the tapered culvert sections may be arranged on curved footers to form a curved conduit. The tapered sections are produced simply by filling or blocking in the lower portion of the forms which produce the culvert sections on end. Thus the tapered culvert section has one end surface which is normal to the side walls and an opposite end surface which is inclined or tapered with respect to the side walls. The tapered sections are arranged on the footers with the normal end surfaces of two adjacent sections abutting each other and with the tapered end surfaces of two adjacent sections each other.

As mentioned above, the precast concrete culvert sections of the invention may also be used to form an underground tank. In this arrangement, the opposite end sections are precast with integral vertical end walls and with an access manhole in the top wall near end wall. The sections are placed on a poured concrete base slab which may be of any length. The assembled sections on the base slab may enclose a rubber-like bladder or "pillow" tank if it is desired to confine a specific fluid. It is also within the scope of the invention to install the culvert sections on footers which project upwardly by a few feet and which are connected by a base slab having a predetermined slope towards a lower surface within the center portion of the slab.

While the precast concrete culvert system herein described constitutes a preferred embodiment of the invention, it is to be understood that the invention is not limited to this precise culvert system, and that changes may be made therein without departing from the scope and spirit of the invention as defined in the appended claims.

The invention having thus been described, the following is claimed:

1. A concrete culvert assembly comprising a set of parallel spaced elongated footers, a plurality of precast concrete culvert sections mounted on said footers in longitudinal alignment, each of said culvert sections having an open bottom and including parallel spaced vertical side walls having bottom surfaces resting on said footers, an arcuate top wall integrally connected to each of said side walls of each said section, said side walls of each said section having opposing inner surfaces defining a span greater than the length of said side and top walls, said arcuate top wall of each section having a generally uniform thickness with a curved inner surface having a radius of curvature at least twice the rise defined between the top center of said curved inner surface and said bottom surfaces of said side walls, said radius of curvature being at least twenty feet and said rise being at least five feet, each of said side walls of each said section having a generally uniform thickness and a generally flat vertical outer surface with a vertical height at least sixty percent of said rise and less than fifty percent of said radius of curvature, said concrete top wall of each said section having a curved outer surface forming a relatively sharp corner with said outer surface of each said side wall, reinforcing members embedded in said concrete of each said section and extending generally parallel to said outer surfaces of said top and side walls, and said inner surface of each said side wall and said inner surface of said top wall of each said section being connected by a surface cooperating with said relatively sharp corner to define a corner thickness substantially greater than the uniform thickness of said side and top walls.

2. A culvert assembly as defined in claim 1 wherein said radius of curvature of said inner surface of said arcuate top wall of each said section is about twenty-five feet and said outer surface of said top wall of each said section forms an angle between 105 degrees and 120 degrees with said outer surface of each said side wall to define said relatively sharp corner.

3. A culvert assembly as defined in claim 1 wherein said radius of curvature of said inner surface of said arcuate top wall is about forty feet.

4. A culvert assembly as defined in claim 1 and including two rows of said culvert sections arranged in parallel spaced relation, means forming longitudinally extending recesses defining seats on the upper portions of the opposing said side walls of said culvert sections in said rows, and separate arcuate concrete panels each having opposite longitudinal edge portions supported by said seats.

5. A culvert assembly as defined in claim 4 wherein each of said concrete panels has a curved inner surface with a radius of curvature generally equal to said radius of curvature of said inner surface of said top wall of each said culvert section.

6. A culvert assembly as defined in claim 1 wherein said surface connecting said inner surfaces of said top wall and each side wall of each said section has a radius of curvature of several feet.

7. A concrete culvert assembly comprising a set of parallel spaced elongated footers, a plurality of precast concrete culvert sections mounted on said footers in longitudinal alignment, each of said culvert sections having an open bottom and including parallel spaced vertical side walls having bottom surfaces resting on said footers, an arcuate top wall integrally connected to each of said side walls of each said section, said side walls of each said section having opposing inner surfaces defining a span greater than the length of said side and top walls, said arcuate top wall of each section having a generally uniform thickness with a curved inner surface having a radius of curvature at least twice the rise defined between the top center of said curved inner surface and said bottom surfaces of said side walls, said radius of curvature being at least twenty feet and said rise being at least five feet, each of said side walls of each said section having a generally uniform thickness and a generally flat vertical outer surface with a vertical height at least sixty percent of said rise and less than fifty percent of said radius of curvature, said concrete top wall of each said section having a curved outer surface forming a relatively sharp corner with said outer surface of each said side wall, reinforcing members embedded in said concrete of each said section and extending generally parallel to said outer surfaces of said top and side walls, said inner surface of each said side wall and said inner surface of said top wall of each said section being connected by a surface cooperating with said relatively sharp corner to define a corner thickness substantially greater than the thickness of said side and top walls, a pair of substantially vertical wing walls extending outwardly at an angle from the end said culvert seciton, and said wing walls having vertical inner surfaces extending from said vertical inner surfaces of said side walls of said end culvert section.

8. A concrete culvert assembly comprising a set of parallel spaced elongated footers, a plurality of precast concrete culvert sections mounted on said footers in longitudinal alignment, each of said culvert sections having an open bottom and including parallel spaced vertical side walls having bottom surfaces resting on said footers, an arcuate top wall integrally connected to each of said side walls of each said section, said side walls of each said section having opposing inner surfaces defining a span greater than the length of said side and top walls, said arcuate top wall of each section having a generally uniform thickness with a curved inner surface having a radius of curvature at least twice the rise defined between the top center of said curved inner surface and said bottom surfaces of said side walls, said radius of curvature being at least twenty feet and said rise being at least five feet, each of said side walls of each said section having a generally uniform thickness and a generally flat vertical outer surface with a vertical height at least sixty percent of said rise and less than fifty percent of said radius of curvature, said concrete top wall of each said section having a curved outer surface forming a relatively sharp corner with said outer surface of each said side wall, reinforcing members embedded in said concrete of each said section and extending generally parallel to said outer surfaces of said top and side walls, said inner surface of each said side wall and said inner surface of said top wall of each said section being connected by a surface cooperating with said relatively sharp corner to define a corner thickness substantially greater than the thickness of said side and top walls, and an end said culvert section includes a vertical head wall projecting upwardly from the end of said top wall.

* * * * *